US005782648A

United States Patent [19]

Peterson

[11] Patent Number: 5,782,648

[45] Date of Patent: Jul. 21, 1998

[54] ELECTRICAL PLUG ATTACHMENT SYSTEM

[76] Inventor: Edwin R. Peterson, 4420 Hillcrest, Boise, Id. 83705

[21] Appl. No.: 679,698

[22] Filed: Jul. 11, 1996

[51] Int. Cl.[6] ..... H01R 13/62

[52] U.S. Cl. ..... 439/369; 439/371; 24/16 PB; 24/17 AP

[58] Field of Search ..... 439/369, 371, 439/373; 24/16 PB, 17 AP, 306

[56] References Cited

U.S. PATENT DOCUMENTS

| | | | |
|---|---|---|---|
| 3,475,716 | 10/1969 | Laig | 439/369 |
| 3,609,638 | 9/1971 | Darrey | 439/69 |
| 3,960,432 | 6/1976 | Wilbur | 439/371 |
| 4,066,313 | 1/1978 | Von dem Hasen | 439/371 |
| 4,371,137 | 2/1983 | Anscher | 24/16 PB |
| 4,898,542 | 2/1990 | Jones, Jr. | 439/369 |
| 5,299,099 | 3/1994 | Archambault | 439/373 |

*Primary Examiner*—J. J. Swann
*Attorney, Agent, or Firm*—Frank J. Dykas

[57] ABSTRACT

A device to secure an electric plug to a wall outlet by the use of a fastener which attaches to the electric cord and which also attaches to the wall socket. The device is of two pieces, to allow adjustment for the size of the electrical plug. The device attaches to the wall socket by the use of a shouldered screw which replaces the standard screw holding the wall place in place. One version of the device is designed to securely connect an electric plug to an extension cord.

11 Claims, 6 Drawing Sheets

ELECTRICAL PLUG ATTACHMENT SYSTEM

BACKGROUND OF THE INVENTION

TECHNICAL FIELD

The present invention generally relates to electrical devices, and more particularly to connecting devices for electric cords.

BACKGROUND

Electrical appliances in common use today utilize an electric cord with a male electrical plug at its end. The electrical plug has two protruding electrodes and may also contain a third protrusion which is a ground terminal. These electrical plugs are inserted into duplex fixtures mounted flush with the wall, or to the female end of extension cords which are in turn connected to a permanent wall mount of some kind. The protruding electrodes of these electrical plugs are kept in place in the wall socket by friction. There are a number of reasons why the friction holding the electrical plug into the wall socket may be insufficient to maintain the electrical connection. The electrodes of the electrical plug may become bent, or the electrodes of the wall socket may become loose, and the friction between the two may be inadequate to resist gravity on the electrical plug. Additionally, the plug may be pulled from the wall due to a person tripping over or stepping on the cord, or a person using an appliance which results in tugging on the cord. Some devices also exist which roll up the electrical cord and exert a pull on the plug at the wall socket. As an example of this kind of winding device, some vacuum cleaners and other appliances will wind up the electrical cord when a button is pressed. If the force of the winding action exceeds the friction applied at the electrodes of the electrical plug, the plug will be pulled out of the wall. This is often not desirable and can be very unhandy, especially if the wall socket is located in a hard-to-reach location.

Accordingly, it is an object of the invention to provide a device which securely attaches electrical plugs to wall outlets.

A further object of the invention is to firmly attach the male end of an electrical plug to the female end of an electrical extension cord plug.

Another object of the invention is to provide a means of securing electrical plugs to wall outlets or to the female end of extension cords, which can be either permanent or removable.

Additional objects, advantages and novel features of the invention will be set forth in part in the description which follows, and in part will become apparent to those skilled in the art upon examination of the following, or it may be learned by practice of the invention. The objects and advantages of the invention may be realized and attained by means of the instrumentalities in combination particularly pointed out in the appended claims.

DISCLOSURE OF INVENTION

According to the present invention, the foregoing and other objects and advantages are obtained by a device which in one form attaches an electric plug to a wall outlet, and in another form attaches an electric plug to an extension cord.

In accordance with one aspect of the invention, the electric plug securing device includes an anchor post for attachment to the wall socket, a first connecting piece for attachment to the anchor post, a means of attaching the first connector to the anchor post, a second connector piece for attachment to the first connecting piece and the electric plug, a means of attaching the second connector piece to the first connecting piece, and a means of attaching the second connector piece to the electric plug. The anchor posts of this device can be a screw with a shoulder portion which replaces the screw which holds the wall plate in place, and a post and head portion which extends above the shoulder portion. The first connecting piece of the electric plug securing device can attach to the anchor post by lever arms whose overlap forms an orifice and in which the orifice interfits with the anchor post. This loop formed from the overlap of lever arms is also the means of detaching the first connecting piece from the anchor post. The first connecting piece of the electric plug securing device attaches to a second connector piece by locking teeth, hook and loop attachment, by adhesive attachment, or by a mechanical connection, such as by welding or the use of screws. The linking together of a first connecting piece and a second connector piece can be accomplished using any of the above or other means of attachment, as well as the use of guide loops for maintaining the orientation of the first and second connector piece. A second connector attaches to the electrical cord by the use of a strap with locking teeth, or by a strap with hook and loop attachment, or by other means.

In accordance with another aspect of the invention, the device includes four connecting pieces, a means of attaching the first connecting piece to the electric cord, a means of attaching the first connecting piece to the second connecting piece, a means of attaching the second connecting piece to a union point, a means of attaching the third connecting piece to the union point, a means of attaching a third connecting piece to the fourth connecting piece, and a means of attaching the fourth connecting piece to a second electric cord. This configuration of connecting device allows a male electric plug from an appliance to be connected to a female electric plug from an extension cord and for the connecting device to firmly hold the two plugs in electrical communication.

In this version of the device, the first connecting piece attaches to the first electric cord using a strap with locking teeth and a loop, or a hook and loop closure or other means. The first connecting piece can attach to the second connecting piece by means of locking teeth and a loop, hook and loop attachment, by the use of adhesives, or by the use of a mechanical connection, such as a screw or weld.

The second connecting piece attaches to the union point, which can be a post with a head or other devices. A second connecting piece can attach to the union point by the use of a linking loop which is formed from overlapping lever arms. This linking loop which is formed by overlapping lever arms also is the means of detaching the second connector from the union point. The linking loop which is part of the second connector is attached to or detached from the union post by the application of force to at least one of the lever arms. The linking loop attaches to and detaches from the union point which can be a post with a head.

This post and head configuration can be attached to the third connecting piece as an integral part of that unit. The third connecting piece is attached to the fourth connecting piece by means of locking teeth, a hook and loop attachment, by the use of adhesive surfaces, by the use of mechanical connections such as by screws or welds, or by the use of guide loops. The means of attaching the fourth connector piece to the second electric cord can be a strap with locking teeth and a guide loop or a strap with hook and loop surfaces.

BEST MODE FOR CARRYING OUT INVENTION

Figure 1:
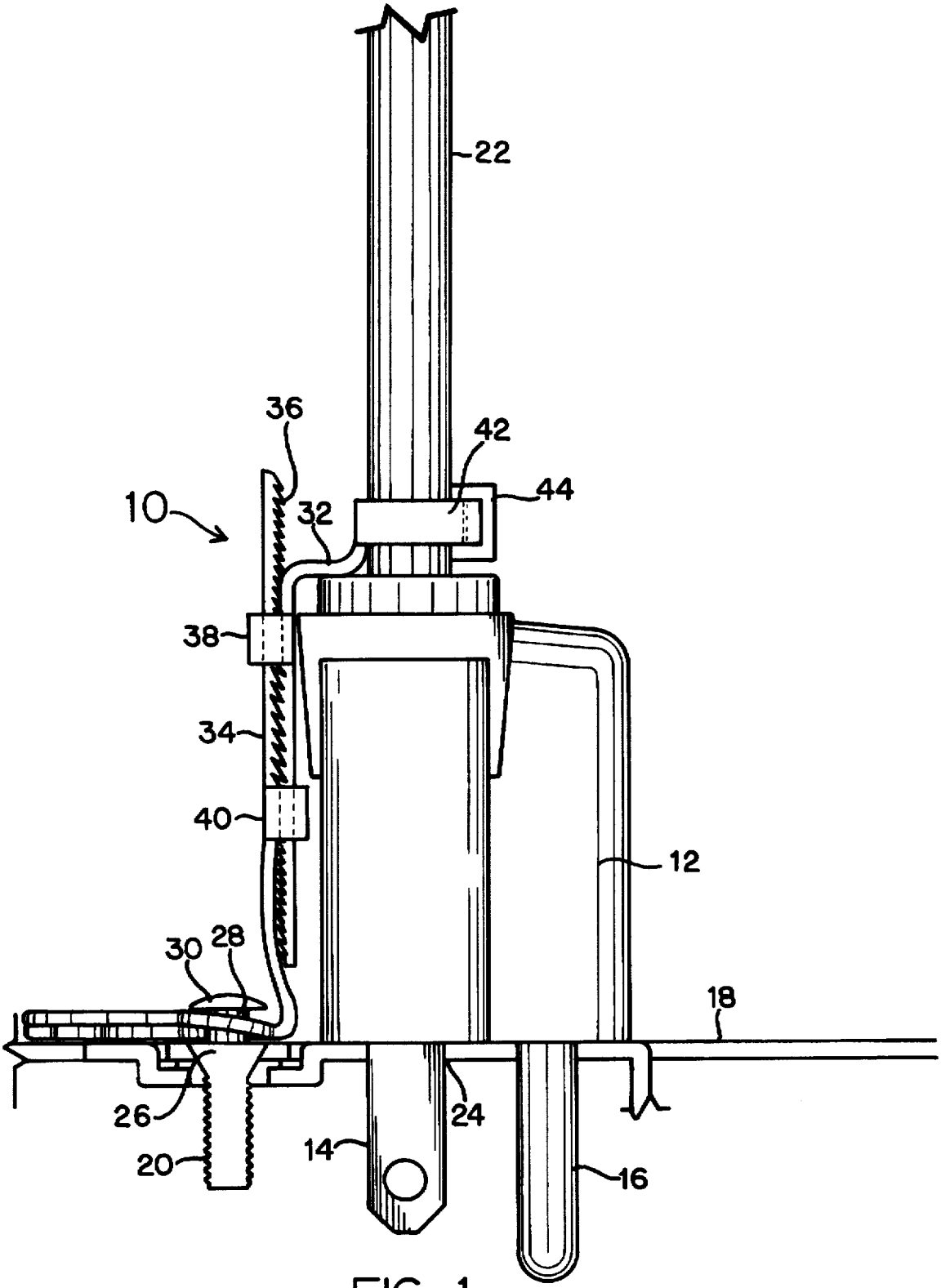
FIG. 1 is a side view of the electric plug attachment system with an electric plug inserted into a wall outlet
Figure 2:
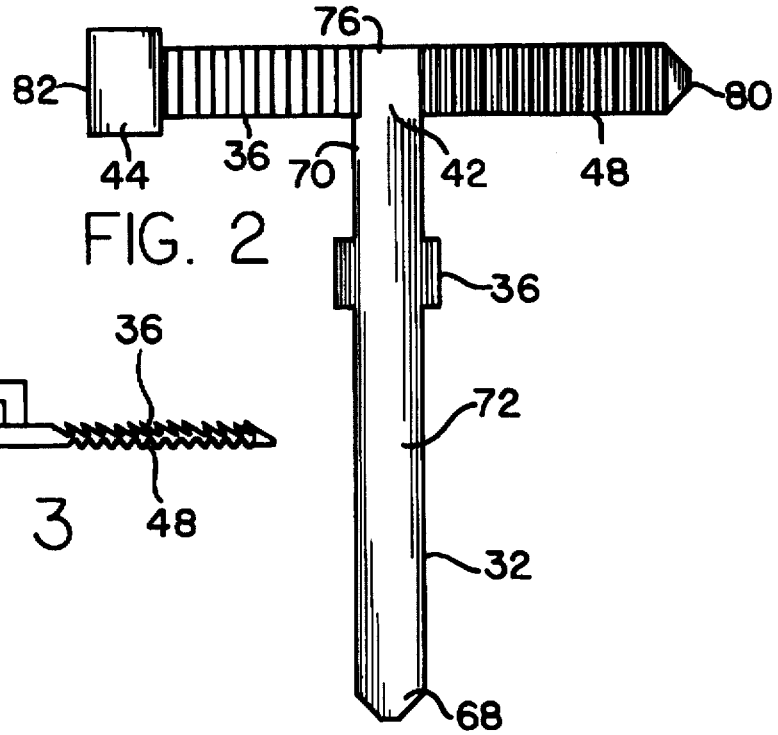
FIG. 2 is a top view of a first connecting piece of an electric plug attachment system.
Figure 3:
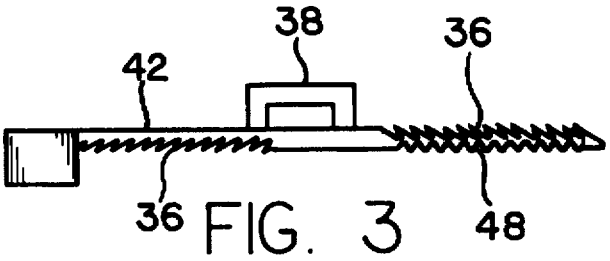
FIG. 3 is an end view of a first connecting piece.
Figure 4:
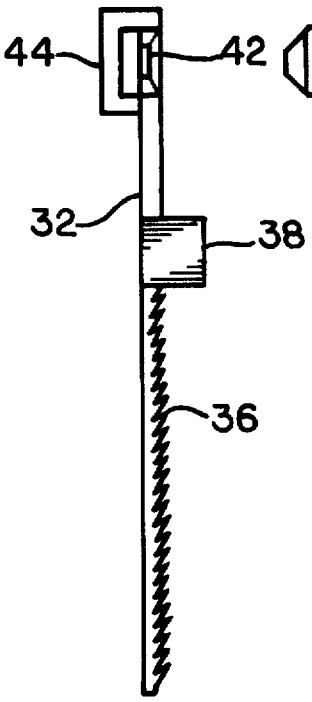
FIG. 4 is a side view of a first connecting piece.
Figure 5:
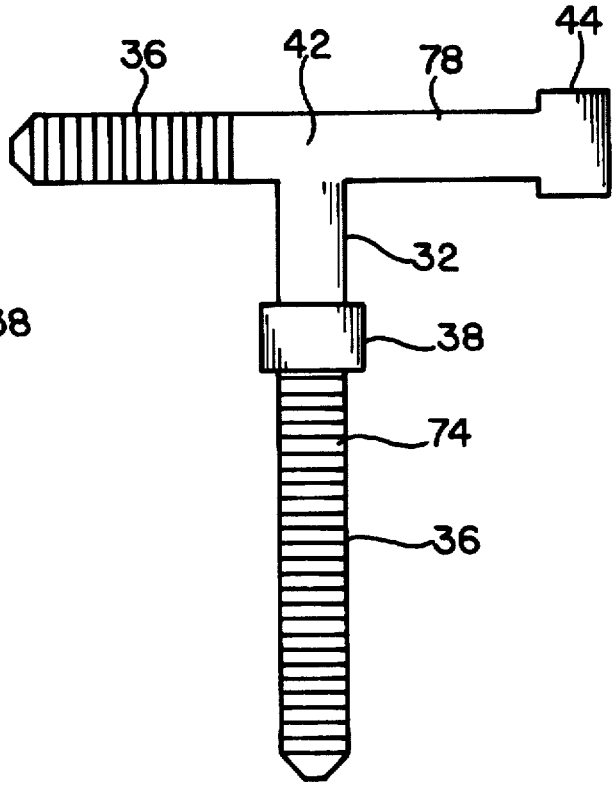
FIG. 5 is a bottom view of a first connecting piece.

One preferred embodiment of the present invention is depicted in operation in FIG. 1. Drawings of its individual parts are depicted in FIGS. 2 through 11. The device is comprised of a first connecting piece 32, a second connector piece 34, and replacement plate screw 20. The first connector 32 and second connector 34 can be made from a variety of materials, including plastics, nylon, Mylar® or other materials.

The first connecting piece 32, shown in FIGS. 2 through 7, has a first end 68 and a second end 70. The first connecting piece also has a first side 72 and a second side 74. First end 68 of first connecting piece ends in a blunt point. A generally flat cord strap 42 is attached to the first connecting piece 32 at second end 70. Cord strap 42 has a blunt point at one end and a loop at the other end. First connecting piece 32 has a loop attached to it about one-third of the way between first end 68 and second end 70, nearest to second end 70. First side 72 of first connecting piece 32 has a smooth surface. First side 76 of cord strap 42 has gripping teeth 48 for about a third of its length, starting from blunt end 80. First side 76 of cord strap 42 has locking teeth 36 on the loop end 82 of cord strap 42. The locking teeth 36 are made to mesh with other locking teeth 36 in a positive manner. A tooth angle of about 60° is shown, but other angles greater than 90° can be used.

On second side 74 of first connecting piece 32 are located locking teeth 36 which extend about two-thirds of the distance from first end 68 towards second end 70, beginning at first end 68. Where locking teeth 36 end nearest to second end 70, is located guide loop 38, attached to first connecting piece 32. On second side 78 of cord strap 42 are located locking teeth 36. These locking teeth occupy approximately one-third of cord strap 42, beginning at the blunt end 80.

Figure 8:
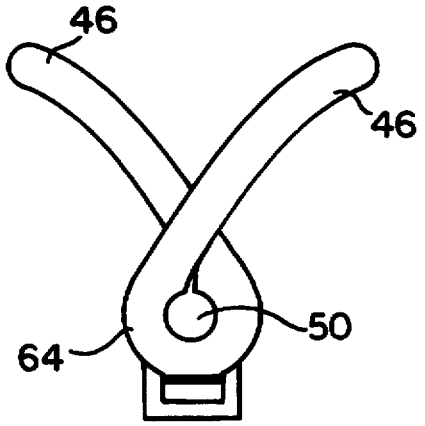
FIG. 8 is a view of second connector piece looking from the locking loop towards the teeth of the second connecting unit.
Figure 9:
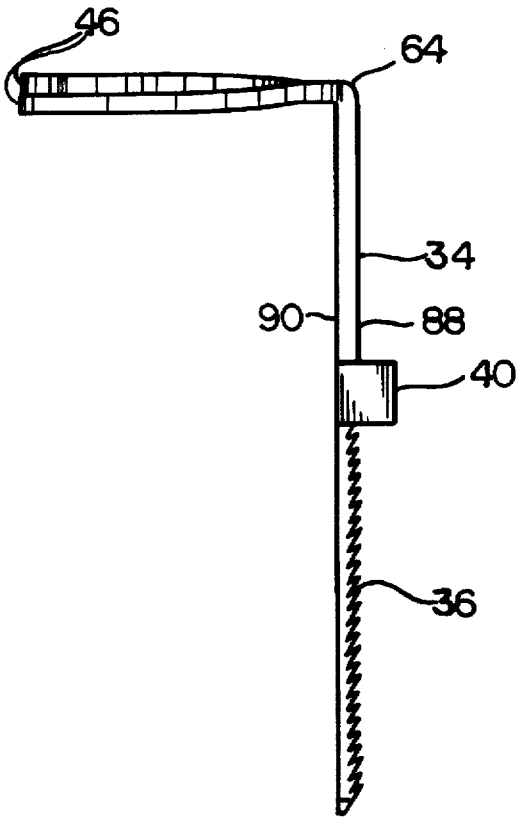
FIG. 9 is a side view of a second connector piece.
Figure 10:
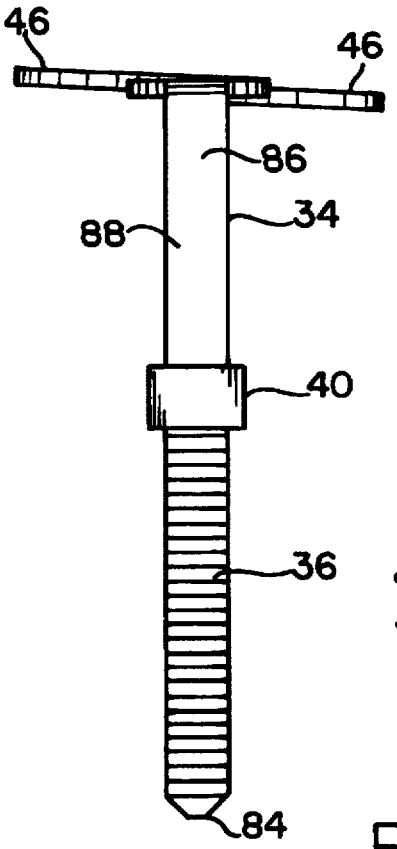
FIG. 10 is a back view of a second connector piece.

Second connecting piece 34, shown in FIGS. 8 through 10, is also a generally flat, narrow strip which can be composed of a number of materials such as plastic, nylon, Mylar®, or other materials. First end 84 of second connecting piece is a generally blunt point. First side 88 of the second connecting piece 34 has locking teeth 36. These locking teeth occupy about half of first side 88 of second piece 34, beginning at first end 84. Near where the teeth end towards second end 86 is located guide loop 40. Second side 90 of the second connector piece 34 is smooth and does not contain teeth. To the second end 86 of the second connecting piece 34 is attached a pair of lever arms 46 which overlap to form an enclosed orifice 50 near their point of attachment to second connecting piece 34.

Figure 11:
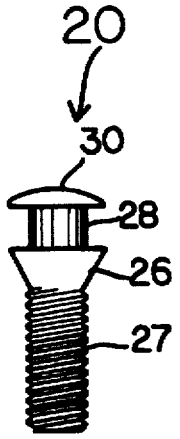
FIG. 11 is a side view of the anchor post.

The third component of this embodiment is replacement plate screw 20, which is depicted in FIG. 11. Replacement plate screw 20 consists of threads 27, shoulder 26, screw head 30 and anchor post 28. Threads 27 are at the end of replacement plate screw 20 opposite screw head 30. Screw shoulder 26 is located where the threads end at a point about three-quarters of the length of the shaft of replacement plate screw 20 from the end where threads 27 begin.

Figure 6:
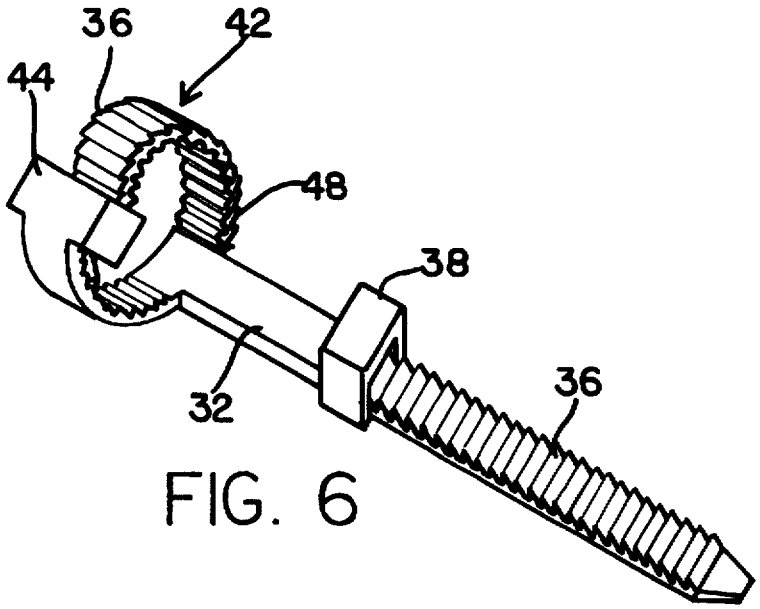
FIG. 6 is a perspective view of a first connector with the cord strap inserted through the cord strap loop of the first connecting piece.
Figure 7:
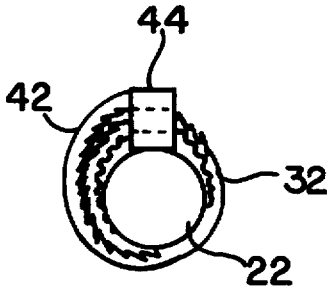
FIG. 7 is a cross-sectional view of an electric cord with the cord strap of a first connecting piece wrapped around it.

This first embodiment of the invention is operated by first removing the original plate screw from the wall outlet and substituting replacement plate screw 20 for it. The screw shoulder 26 serves the same function as the counter sunk head of the screw in the original screw in the wall outlet, and holds the wall outlet face 18 in place. Once installed, the anchor post 28 and the screw head 30 extend out from the wall outlet face 18. The next step in using the device is to attach first connecting piece 32 to electric cord 22. This attachment process is depicted in FIGS. 6 and 7. To attach first connecting piece 32 to electric cord 22, first connecting piece 32 is placed parallel to the longitudinal axis of electric cord 22 and electric plug 12. Next, cord strap 42 is encircled around electric cord 22 and end 80 of cord strap 42 is fed through cord strap loop 44. As this occurs, locking teeth 36 on first side 76 engage with locking teeth 36 on second side 78 of cord strap 42. As these two sets of teeth engage, cord strap 42 becomes locked on electric cord 22. As end 80 continues to pass through loop 44, and the circle thus formed grows smaller and smaller, gripping teeth 48 begin to contact the outer surface of electric plug 22. This process is complete when cord strap 42 is tightly wrapped around electric cord 22. The next step of the process is to insert first end 84 of second connecting piece 34 through guide loop 38 of first connecting piece 32. Simultaneously with end 84 entering loop 38, end 68 of first connecting piece 32 enters guide loop 40 of second connecting piece 34. Each of these ends is extended through the opposite loop and in so doing, gripping teeth 36 on surface 88 of the second connecting piece 34 and gripping teeth 36 of side 74 of first connecting piece 32 engage each other in a ratcheting fashion. The first connecting piece 32 and the second connecting piece 34 are advanced over the locking teeth 36 of each other until second end 86 of second piece 34 extends just beyond the end of electric plug 12. At that point, advancement is stopped and the unit is ready for insertion into the electric outlet 18. When the electric plug 12 is inserted into outlet 18, the screw head 30 is located immediately below orifice 50. With slight pressure or with the pressing together of the lever arms 46, screw head 30 is made to extend through orifice 50 of locking loop 64. When this occurs, the electric plug lock device 10 is anchored to the wall outlet by replacement plate screw 20, and electric plug 12 is attached to replacement plate screw 20. In this position, the electric plug 12 will resist being removed from wall outlet 18.

In order to remove electric plug 12 from wall outlet 18, lever arms 46 are pressed so that their tips approach each other. This causes orifice 50 to become larger in size, and allows screw head 30 to pass through orifice 50. Once the locking loop 64 is disengaged from anchor post 28 and screw head 30, electric plug 12 is free to remove from outlet 18.

Figure 12:
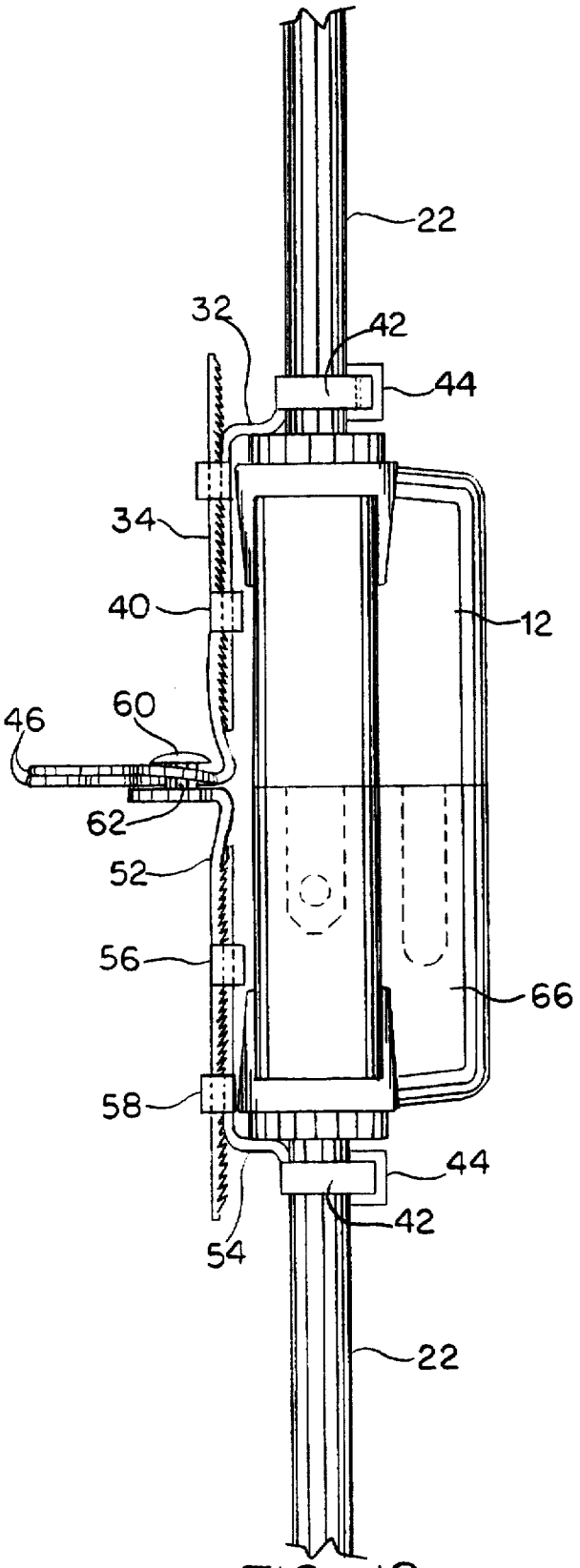
FIG. 12 is a side view of an electrical plug inserted into an extension cord female plug with an electric plug attachment system holding them together.
Figure 15:
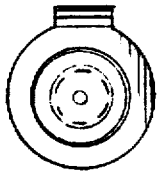
FIG. 15 is a top view looking down at the locking post head of a third connector of an electric plug attachment system.
Figure 13:
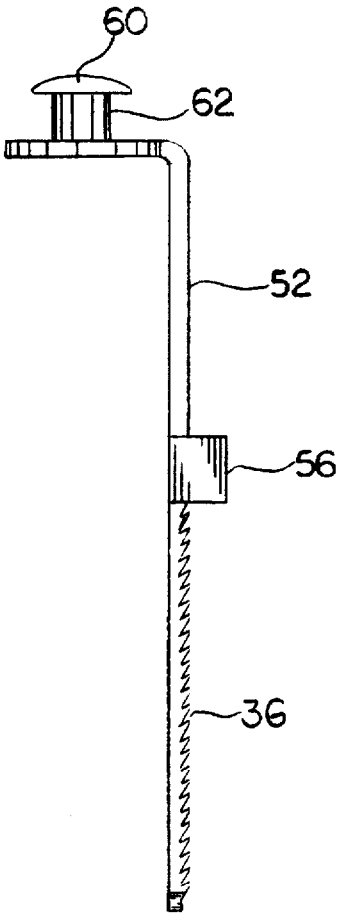
FIG. 13 is a side view of the third connector of a dual cord electric plug attachment system.
Figure 14:
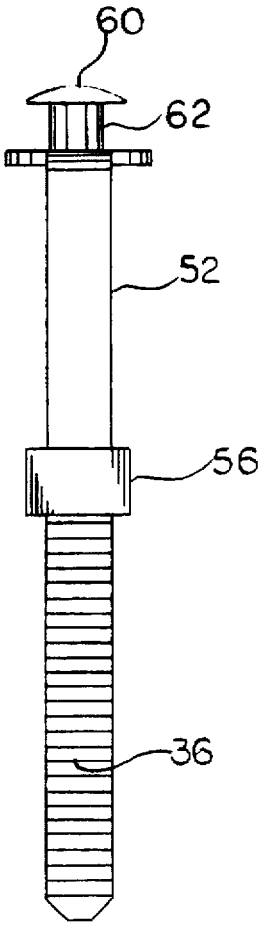
FIG. 14 is a back view of the third connector of an electric plug attachment system.

A second preferred embodiment is shown in FIGS. 12, 13, 14 and 15. This embodiment is one which is used to connect electric plug 12 with extension cord female end 66. In this embodiment, a first piece 32 is used which is identical to the first connecting piece 32 of the previous embodiment. A second connecting piece 34 is also used which is identical to the second connecting piece 34 of the previous embodiment. A third connecting piece 52 is also used. A fourth connecting piece 54 is also used which is identical to the first connecting piece 32 of the previous embodiment. As shown in FIGS. 13, 14 and 15, third connecting piece 52 includes gripping teeth 36, dyed loop 56, anchor post 62 and post head 60. In operation, the four pieces of this embodiment are assembled as shown in FIG. 12. First piece 32 attaches to electric cord 22 in the same manner as described in the previous embodiment. Second connecting piece 34 is joined to first connecting piece 32 in the same manner as described in the previous embodiment. Fourth connecting piece 54 is attached to electric cord 22 in the same manner as described for the first connecting piece 32. Third connecting piece 52 is joined to fourth connecting piece 54 in the same manner as previously described. Anchor post 62 and the post head 60 of the third connecting piece 52 serves as the point of attachment between the second connecting piece 34 and the third connecting piece 52. Second connecting piece 34 is joined to third connecting piece 52 when electric plug 12 is inserted into extension cord female end 66. This causes orifice 50 to contact post head 60 and be pressed open into engagement. To release engagement, lever arms 46 are pressed so that their tips approach each other. This causes orifice 50 to enlarge and allows the release of post head 60 by locking loop 64.

While there is shown and described the present preferred embodiment of the invention, it is to be distinctly understood that this invention is not limited thereto but may be variously embodied to practice within the scope of the following claims.

I claim:

1. A first electric plug securing device, for securing an electric plug, comprising:

an anchor post for attachment to the wall socket;

a first connector for attachment to the anchor post and a second connector;

a means of attaching and detaching the first connector to the anchor post;

a second connector for attachment to the first connector and the electric plug;

a means of attaching the second connector to the first connector;

a means of attaching the second connector to the electric plug, wherein the means of attaching the first connector to the anchor post is a loop formed from overlapping resilient lever arms.

2. The electric plug securing device of claim 1 which further comprises an anchor post which is a shouldered screw which replaces a screw which holds a wall plate in place.

3. The electric plug securing device of claim 1 in which the means of detaching the first connector to the anchor post is a loop formed from overlapping lever arms.

4. The electric plug securing device of claim 3 in which an orifice diameter expands by means of application of force to at least one of the lever arms.

5. The electric plug securing device of claim 1 in which the means of attaching the first connector to the second connector is locking teeth.

6. The electric plug securing device of claim 1 in which the means of attaching the first connector to the second connector is hook and loop.

7. The electric plug securing device of claim 1 in which the means of attaching the first connector to the second connector is adhesive.

8. The electric plug securing device of claim 1 in which the means of attaching the first connector to the second connector is a mechanical connection.

9. The electric plug securing device of claim 1 in which the means of attaching the first connector to the second connector utilizes guide loops.

10. The electric plug securing device of claim 1 in which the means of attaching the second connector to the electric cord is a strap with locking teeth and a loop.

11. The electric plug securing device of claim 1 in which the means of attaching the second connector to the electric cord is a strap with hook and loop closure.

* * * * *